US007478592B2

(12) United States Patent
Zahnd et al.

(10) Patent No.: US 7,478,592 B2
(45) Date of Patent: Jan. 20, 2009

(54) CLAMPING DEVICE FOR CLAMPING A FLEXIBLE COVERING ON A CYLINDER OF A PRINTING MACHINE

(75) Inventors: Andreas Zahnd, Zollikofen (CH); André Kolzem, Bern (CH)

(73) Assignee: Maschinenfabrik WIFAG, Bern (CH)

( * ) Notice: Subject to any disclaimer, the term of this patent is extended or adjusted under 35 U.S.C. 154(b) by 324 days.

(21) Appl. No.: 10/526,451

(22) PCT Filed: Sep. 24, 2003

(86) PCT No.: PCT/CH03/00639

§ 371 (c)(1),
(2), (4) Date: Mar. 2, 2005

(87) PCT Pub. No.: WO2004/028808

PCT Pub. Date: Apr. 8, 2004

(65) Prior Publication Data

US 2006/0150845 A1 Jul. 13, 2006

(30) Foreign Application Priority Data

Sep. 26, 2002 (DE) ..... 102 44 944
Sep. 26, 2002 (DE) ..... 102 44 945

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS 2,900,904 A 8/1959 Hantscho ..... 101/415.1
4,577,560 A 3/1986 Banike ..... 101/415.1
5,010,818 A 4/1991 Wallschlaeger, Sr. ..... 101/415.1
5,123,353 A 6/1992 Beck ..... 101/415.1
5,485,784 A * 1/1996 Walschlaeger, Sr. ..... 101/415.1

(Continued)

FOREIGN PATENT DOCUMENTS

DE 26 20 427 11/1977

(Continued)

*Primary Examiner*—Leslie J Evanisko
(74) *Attorney, Agent, or Firm*—McGlew & Tuttle, P.C.

(57) ABSTRACT

A clamping device for clamping a flexible packing (2, 3) of a cylinder (1) of a printing press, which cylinder has an axial channel (6) on a jacket surface, the clamping device includes a clamping body (10), which has a surface (S) that forms in the channel (6) with an opposite surface (4) a clamping gap for at least one end of the packing (2, 3) protruding through an opening (7) of the channel (6). A pressing device (13; 14; 10*a*) presses the clamping body (10) and the opposite surface (4) against each other with a clamping force (F). A mounting device (12; 14; 1, 8), which forms a support surface (9; 14'; 9'), touches the clamping body (10) and the clamping body (10) is supported on it. A center of gravity (SP) of the clamping body (10) can be moved, while the clamping gap is maintained, at right angles to an axis of rotation ($D_Z$) of the cylinder (1) in a first direction relative to the cylinder (1) and the support surface (9; 14'; 9') and in a second direction that is not parallel to the first direction in relation to the cylinder (1).

30 Claims, 4 Drawing Sheets

U.S. PATENT DOCUMENTS 5,485,785 A 1/1996 Schneider et al. ..... 101/487

FOREIGN PATENT DOCUMENTS

| | | |
|---|---|---|
| DE | 35 35 138 | 4/1987 |
| DE | 42 38 343 | 5/1994 |
| DE | 44 15 624 | 11/1995 |
| DE | 195 09 561 | 9/1996 |
| DE | 196 06 744 | 8/1997 |
| DE | 200 22 737 UI | 4/2002 |
| DE | 101 08 745 | 5/2002 |
| EP | 0 856 401 | 4/1998 |

* cited by examiner

CLAMPING DEVICE FOR CLAMPING A FLEXIBLE COVERING ON A CYLINDER OF A PRINTING MACHINE

FIELD OF THE INVENTION

The present invention pertains to a clamping device of a printing press cylinder, which is used to fasten a flexible packing of the cylinder clampingly on the cylinder.

BACKGROUND OF THE INVENTION

A clamping device as the one to which the present invention pertains is needed especially for rubber blanket cylinders and/or printing cylinders of rotary printing presses to fasten a rubber blanket or a flexible printing form, which is tensioned on a jacket surface of such a cylinder, on the cylinder while maintaining the tension. The cylinders have one or mostly a plurality of axial channels on their jacket surface, in which channel or channels a clamping device each is formed.

EP 0 856 401 A2 discloses an axial channel, which has channel walls that converge obliquely at an acute angle in relation to one another up to a channel opening on the jacket surface of the printing cylinder. A clamping body with lateral surfaces extending toward each other is arranged in the channel and tensioned in the direction of the channel opening, so that its two lateral surfaces are pressed against the channel walls converging at the same angle. A clamping gap is formed for the packing between one of the two channel walls and the lateral surfaces of the clamping body facing it. The clamping gap is set by means of bearing bodies, which are arranged adjustably at right angles to the clamping body.

Clamping devices that have clamping cams arranged pivotably in a channel of a printing cylinder are known from DE 195 09 561 A1 and DE 200 22 737 U1. The clamping cams are pivotable to and fro between a clamped position and a released position.

The prior-art clamping devices are not yet optimal especially in respect to their handling.

U.S. Pat. No. 5,010,818 discloses a clamping device that comprises a plurality of cylindrical clamping bodies, each of which is directly supported in an elastically nonrigid manner on a spring element in the radial direction of a printing cylinder. Even though the clamping bodies are movable in two non-parallel directions at right angles to an axis of rotation of the cylinder, partly due to the radial inward spring excursion of the spring elements and partly in the tangential direction of the cylinder, the movement in the tangential direction is associated with tilting and/or bending of the spring elements.

U.S. Pat. No. 5,123,353 discloses a clamping device with a clamping shaft, which is mounted movably on a mounting means of a pressing means against a force of elasticity generated by the pressing means. The clamping shaft has a regular cylindrical shape over part of its outer circumference and has a polygonal shape with either two or three flattened areas opposite the regular cylindrical part. It lies on the mounting means with its flattened areas. Depending on the number of flattened areas, it can assume two or three discrete angle of rotation positions. It is shaped such on the regular cylindrical part of its circumference that it does not form a clamping gap during the clamping of the ends of the packing. To clamp the ends of the packing, the clamping shaft is rotated by means of a tool into a predetermined angle of rotation position, in which it presses the ends of the packing against one of the gap ends of the cylinder channel, forming a clamping gap. Furthermore, two axial side walls of the channel, between which the clamping shaft is set movably, act as abutments for the clamping shaft.

Other clamping devices are known from DE 42 38 343 A1, U.S. Pat. No. 2,900,904, U.S. Pat. No. 5,485,785, DE 35 35 138 A1, DE 101 08 745 C1, DE 44 15 624 A1, DE 26 20 427 B2, and U.S. Pat. No. 4,577,560.

SUMMARY OF THE INVENTION

One object of the present invention is to provide a clamping device for clamping a flexible packing of a cylinder of a printing press, by means of which a cylinder packing is securely clamped and which is easy to handle.

The present invention pertains to a clamping device of a cylinder of a printing press, preferably a printing press for printing large newspaper editions. The cylinder has an axial channel on its jacket surface. The clamping device comprises at least one clamping body, a mounting means, at which the at least one clamping body is supported, and a pressing means for the clamping body. The at least one clamping body has a surface that forms a clamping gap in the cylinder channel with an opposite surface for at least one end of at least one flexible packing, which said end protrudes through a channel opening. The opposite surface is preferably a channel wall that is formed by the cylinder itself or is connected with the cylinder. However, the opposite surface may, in principle, also be movable in the channel in relation to the cylinder, e.g., it may itself likewise be rotatable, in order to facilitate the introduction of a free end of the packing into the clamping gap. The pressing means generates a clamping force, with which the at least one clamping body and the opposite surface are pressed toward each other to form the clamping gap. The at least one clamping body and the opposite surface are preferably pressed against each other already before the at least one end of the packing is pulled in. However, the pressing force may, in principle, also be brought about only by the introduction of the end of the packing.

The at least one clamping body is mounted according to the present invention such that while the clamping gap is maintained, its center of gravity can be moved at right angles to a longitudinal axis of the cylinder in two non-parallel directions in relation to the cylinder and also in relation to the mounting means in one of the directions. The at least one clamping body thus has two degrees of freedom of movement in the plane of the cross section of the cylinder and permanently presses the opposite surface. The two directions of mobility of the center of gravity of the clamping body and the axis of rotation of the cylinder preferably form a right angle with each other. If the at least one end of the packing is pushed or pulled into the clamping gap, the at least one clamping body is moved against the clamping force away from the opposite surface or is elastically compressed or it both moves away and is compressed in combination by the thickness of the end of the packing. During the displacement of its center of gravity, the at least one clamping body is permanently supported on support surfaces and held in this manner. The opposite surface which also forms the clamping gap forms one of the support surfaces. At least two more support surfaces point at an angle to the opposite surface and also at an angle to each other. The at least one clamping body is preferably supported and centered by three support surfaces. One advantage of the arrangement of the at least one clamping body according to the present invention is that no setting operations are needed for preparing the clamping gap. The at least one clamping body does not need to be moved first from a released position into a clamped position, but it is always in the clamped position.

The at least one end of a packing can be pushed or pulled into the clamped position. Two ends of the same packing or one end each of two packings are preferably clamped in the clamping gap.

In a preferred embodiment, the mounting means is movable against a force exerted by the pressing means on the at least one clamping body at right angles to the axis of rotation of the cylinder. The mounting means can be moved here in one of the two directions of mobility of the at least one clamping body. The mounting means supports the at least one clamping body in one of the two directions of its mobility and guides it in the other direction. The mounting means correspondingly forms a guide path, along which the at least one clamping body is guided, preferably by rolling and/or sliding on the guide path.

The surface of the at least one clamping body, which forms the clamping gap with the opposite surface, may be guided itself on the guide path. However, the clamping body is preferably guided on the guide path in another manner, preferably by means of a meshing member that is rigidly or optionally rotatably connected to the at least one clamping body. The circumference of the meshing member should press the opposite surface, and the meshing member should preferably press only the mounting means. It may project from the clamping body as a pin, i.e., as a bearing journal. The meshing member is considered to belong to the clamping body, because it follows the movements thereof in two directions.

The at least one clamping body is supported on support surfaces, which are preferably formed in the channel of the cylinder. One of these support surfaces is preferably formed by the mounting means, which is arranged movably in the channel in preferred embodiments. The other support surfaces may be formed especially by the cylinder itself and/or by a filler rigidly connected with the cylinder.

In a preferred first embodiment, the clamping body is mounted entirely movably in two non-parallel directions. The mounting may be especially a floating mount, which is preferably formed by means of the movably arranged mounting means. The at least one clamping body may be made in this embodiment in one piece and homogeneously from a single material, e.g., steel or a comparably hard and heavy material.

In an alternative, second embodiment, the at least one clamping body is centered between support surfaces, which are not movable in relation to one another. One of the support surfaces is again formed by the opposite surface that participates in the formation of the clamping gap. The at least two, preferably exactly two other support surfaces are preferably formed directly by the cylinder or are rigidly connected with the cylinder. In this exemplary embodiment, the at least one clamping body may have a cylindrical jacket made of an elastically nonrigid material, which envelopes a hard core made of another material. Such a clamping body may, in principle, also be formed entirely from the elastically nonrigid material. However, a hard core made of a material with a density that is higher than that of the material of the jacket is preferred especially when the centrifugal force brought about by the rotary movement of the cylinder shall be utilized to increase the clamping force. It can no longer be said in view of the second embodiment that the at least one clamping body is arranged entirely movably in the channel. However, at least its center of gravity is still movable in the two non-parallel directions. The clamping body forms the pressing means itself in these embodiments. If a hard core with an elastically nonrigid coating is jacketed, the coating is so thick that it can perform an inward spring excursion when viewed over its circumference by at least the thickness of an end of a packing and preferably by at least the thickness of two ends of the packing.

The surface of the at least one clamping body, which participates in the formation of the clamping gap, is preferably shaped such that together with the opposite surface, it forms an opening funnel in the plane of the cross section of the cylinder, which said opening funnel widens to an opening of the channel in order to facilitate the pushing in or pulling in of the at least one end of the packing.

The surface of the at least one clamping body, which participates in the formation of the clamping gap, is preferably shaped such that the clamping force acts only along a narrow, axially extending area even in the case of an elastically nonrigid surface and/or opposite surface. A high specific surface pressure can thus be advantageously attained in the clamping gap.

The at least one clamping body may have a triangular or tetragonal cross section or have another polygonal shape and participate in the formation of the clamping gap with one of its polygon edges. The polygon edges are preferably slightly rounded without the polygonal character being lost as a result. The arrangement is, furthermore, preferably such that a linear clamping force and the opening funnel are formed.

However, the round shape of the surface of the at least one clamping body, which surface participates in the formation of the clamping gap, is markedly preferred to a polygonal shape. It is preferably circular.

Even though the formation of the opening funnel, while the clamping gap or the clamping force acting in the clamping gap is maintained, cooperates especially advantageously with the mobility of the at least one clamping body in the two non-parallel directions, it also offers advantages even without such a mobility, which forms the subject of this application. In an advantageous variant of the opening funnel, the at least one clamping body is arranged rotatably around an axis of rotation and has the round surface that participates in the formation of the clamping gap, preferably around the axis of rotation.

The round surface of the clamping body is shaped such and it extends in the circumferential direction around the axis of rotation of the clamping body to the extent that the clamping gap is maintained during a rotary movement which is performed by the clamping body to clamp and release the packing. The clamping force remains at least essentially the same, preferably in terms of magnitude and direction, during this rotary movement, with unchanged thickness of the clamping gap. The clamping body is in the clamped position in this case over the entire range of angles of rotation over which its round surface participating in the formation of the clamping gap extends. This facilitates the introduction of a free end of the packing into the clamping gap. If the range of angles of rotation over which extends the surface of the at least one clamping body, which surface participates in the formation of the clamping gap, is large enough, the flexible packing may also be tensioned in an advantageous variant by a corresponding rotary movement of the at least one clamping body. The round surface that forms the clamping gap with the clamping body especially preferably extends over 360°. The clamping body is preferably rotatable by 360° around its axis of rotation.

In preferred embodiments, the round surface of the clamping body, which participates in the formation of the clamping gap, is rotationally symmetrical in relation to the axis of rotation of the clamping body. The clamping body is especially preferably designed as a regular cylinder, and the round surface is correspondingly a jacket surface of the regular cylinder. In the case of the rotationally symmetrical design, the at least one clamping body may basically also be a body of revolution deviating from the regular cylinder if a punctiform clamping force is sufficient or even desirable in the clamping gap. In the case of the rotationally symmetrical design, the at least one clamping body advantageously forms the clamping gap in each angle of rotation position over a full revolution, whereby operating errors are counteracted especially reliably.

The pressing means is preferably a spring means, which presses the at least one clamping body and its opposite surface against each other. The pressing means is preferably arranged in the channel. In the design as a spring means, it comprises at least one spring element, which is arranged in the channel and is supported at the cylinder. If the at least one clamping body is arranged rotatably, it is preferably rotatable around its axis of rotation in relation to the pressing means.

A plurality of clamping bodies of the type described may be arranged in preferred embodiments along a shaft or axis at axially spaced locations from one another. The clamping bodies may be formed by the shaft or axis in one piece or fastened on a shaft or axis and preferably secured in this design against rotation on the shaft and expediently against displacement on the shaft or axis. A plurality of spring elements are preferably arranged at spaced locations next one each other along the shaft or axis in order to uniformly press the plurality of clamping bodies against the opposite surface over the entire length of the shaft. If the clamping bodies are rotatable, rotary mounting on an axis is also possible as an alternative to the preferred formation of a shaft. The shaft or axis sections between two adjacent clamping bodies preferably form the above-mentioned pins, via which the clamping bodies are supported on the mounting means.

A plurality of clamping bodies of the type described, which are not connected to one another, are arranged axially next to one another in other preferred embodiments, and a clamping force is applied to each of them, as was described on the basis of a clamping body. Each of the clamping bodies may be mounted separately from each other of the clamping bodies. A plurality of clamping bodies, preferably two clamping bodies each, are preferably connected to one another and form a clamping body group each, which is mounted separately, preferably by means of pins, which connect the adjacent clamping bodies of one group to each other.

The at least one clamping body and the opposite surface forming the clamping gap together with it are preferably arranged in relation to one another such that the clamping force has a direction component that points in the direction of the centrifugal force which acts during the rotary movement of the cylinder. It is preferred, furthermore, for the at least one clamping body as a whole or for at least the center of gravity of the at least one clamping body to be movable in relation to the axis of rotation of the cylinder. The component of the clamping force caused by the centrifugal force at the maximum speed of the cylinder occurring during the operation is advantageously substantially greater than the clamping force component generated by the pressing means.

In the embodiments in which the at least one clamping body is arranged rotatably in the channel, a blocking means may be provided, which connects the clamping body with the cylinder in a blocking engagement such that a reverse rotary movement of the clamping body is prevented from occurring. The blocking engagement can be released in order to make it possible to pull the clamped end of the flexible packing out of the clamping gap. Such a blocking means may be formed especially by a releasable free-running mechanism, which does not hinder the rotary movement of the clamping body in the clamping direction of rotation, but blocks the clamping body against a reverse rotary movement. The blocking means may also be formed by a friction brake that can be engaged and released. However, a blocking means is preferably not used, which is possible especially when the centrifugal force supports the clamping.

Based on the design according to the present invention, the clamping body is rotating in the clamping direction of rotation when the free end is pushed into the clamping gap and rolls with its round surface which participates in the formation of the clamping gap on the free end of the packing. Even though a rotating drive of the at least one clamping body is not necessary, a rotating drive shall not be ruled out. Because of the fact that the clamping gap is maintained over an angle of rotation range, a rotatingly driven clamping body can be used to pull a free end of the flexible packing into the clamping gap and/or to push it out of the clamping gap. A rotating drive may also form at the same time the blocking means, e.g., by the self-locking of the rotating drive. The self-locking may be achieved, e.g., by the use of a worm gear mechanism.

The present invention will be explained below on the basis of exemplary embodiments. Features that become disclosed in the exemplary embodiments represent variants of the subjects of the claims individually and in any combination of features. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
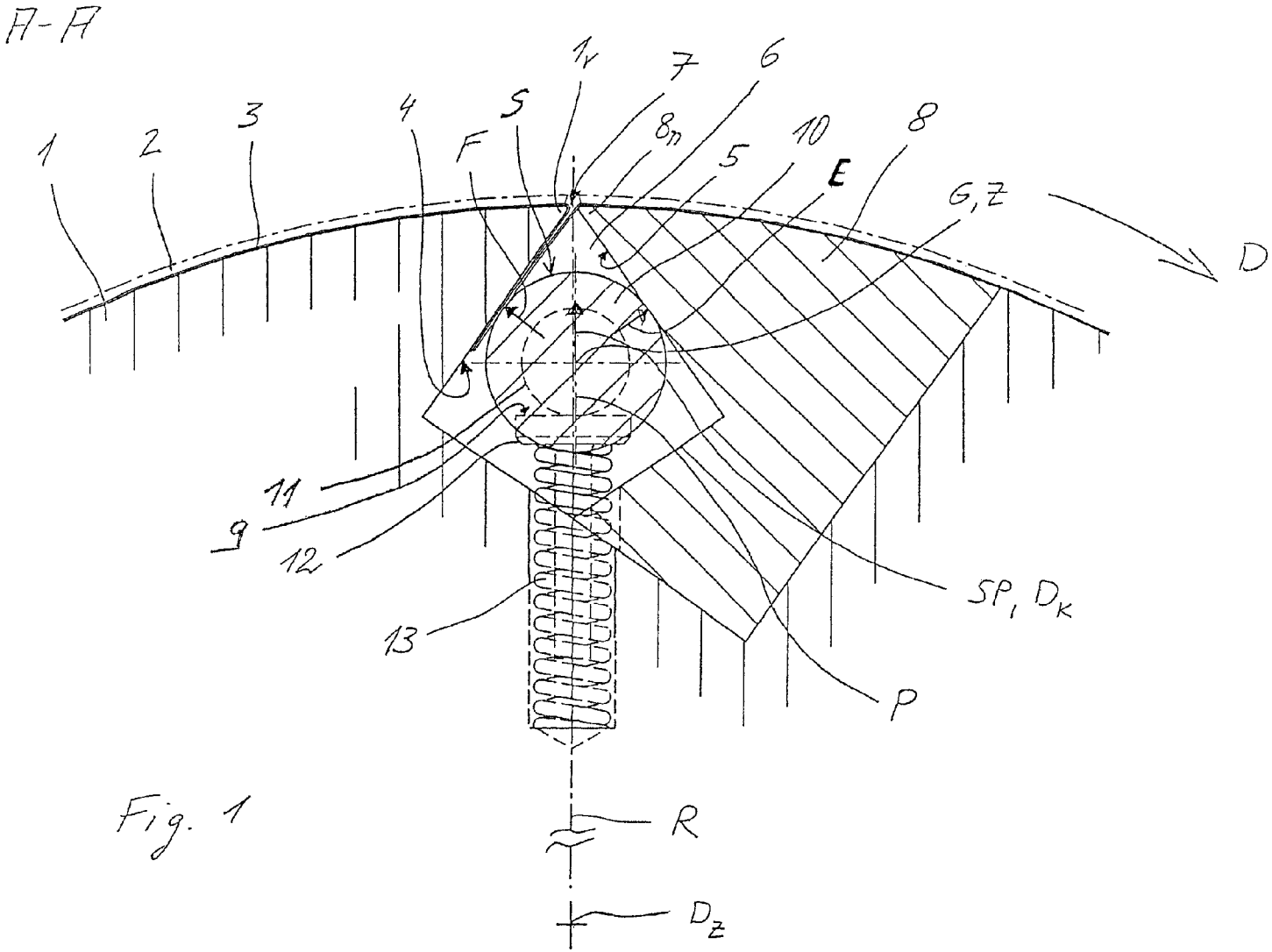
FIG. 1 is a partial sectional view showing a part of a printing cylinder near the jacket surface with an axial channel, in which a clamping device according to a first exemplary embodiment is formed.

Referring to the drawings in particular, FIG. 1 shows a near-the-jacket-surface part of a printing cylinder 1 of a web-fed rotary printing press for the offset printing of large numbers of newspaper copies. The jacket surface of the printing cylinder 1 is spanned with a flexible packing. The flexible packing is a rubber blanket 2 in the exemplary embodiment, which is vulcanized or bonded to a flexible plate 3. The printing cylinder 1 is correspondingly a rubber blanket cylinder. To span the flexible plate 3 with the rubber blanket 2 on the jacket surface, the two free ends of the flexible plate 3 are pushed into a channel 6 and clampingly fastened in the channel 6 by means of a clamping device. The two clamped ends do not need to be the ends of the same plate, and they are indeed not in many applications, e.g., when the printing cylinder is a plate cylinder. The channel 6 extends axially, i.e., in parallel to an axis of rotation $D_Z$ of the cylinder 1 on the jacket surface of the cylinder and forms a narrow channel opening 7 directly on the jacket surface. The channel opening 7 is limited by two limiting edges 1*v* and 8*n*, which are located opposite each other axially in parallel in the circumferential direction. If the cylinder 1 is rotatingly driven in the direction of rotation D indicated by an arrow, the limiting edge 1*v* forms the leading edge and the limiting edge 8*n* forms the trailing edge of the channel opening 7. The channel 6 widens in its cross section from the limiting edges 1*v* and 8*n* on both sides of a radial R to the axis of rotation $D_Z$ of the cylinder 1. The channel opening 7 and the adjoining channel walls 4 and 5 are axially symmetrical in cross section to the radial R. The ends of the flexible plate 3, which are introduced into the channel 6, project beyond the rubber blanket 2. The rubber blanket 2 itself is not introduced into the channel 6, but it forms a narrow slot at the channel opening 7, or the two ends of the rubber blanket 2 abut each other above the channel opening 7.

A clamping device is formed in the channel 6. The clamping device comprises a plurality of clamping bodies 10, which are arranged at spaced locations axially next to each other on a shaft 11, which has an axis of rotation $D_K$. The clamping device comprises, furthermore, a pressing means, which comprises in the exemplary embodiment a plurality of spring elements 13 arranged at spaced locations next to one another along the shaft 11 and a mounting means for the shaft 11. The mounting means is formed by a plurality of mounting pieces 12, namely, one mounting piece 12 each per spring element 13. The spring elements 13 act on the shaft 11 in the radial direction relative to the axis of rotation $D_Z$ of the cylinder 1 via the mounting pieces 12. The clamping bodies 10 are thus pressed by the pressing means in the radial plane of symmetry radially outwardly against the channel walls 4 and 5, which extend on one side each of the radial planes of symmetry from the two limiting edges Iv and 8*n*. The two channel walls 4 and 5 are flat and extend axially. Because of the symmetry, they point to the radial plane of symmetry through which the radial R extends at the same slope angle.

The clamping bodies 10 form on their jacket surfaces S a clamping gap each both with the channel wall 4 on the leading side of the channel 6 and with the channel wall 5 on the trailing side of the channel 6. The channel walls 4 and 5 form the opposite surfaces for the jacket surfaces S of the clamping bodies 10 in the two clamping gaps. The two free ends of the flexible plate 3 are pushed into the clamping gap formed between the jacket surface S and the leading channel wall 4 and are clamped between the channel wall 4 and the jacket surfaces S of the clamping bodies 10 with a linear clamping force F each. The introduction of the plate ends is facilitated by the funnel-shaped opening, which forms the surface S with the opposite surface 4.

Figure 2:
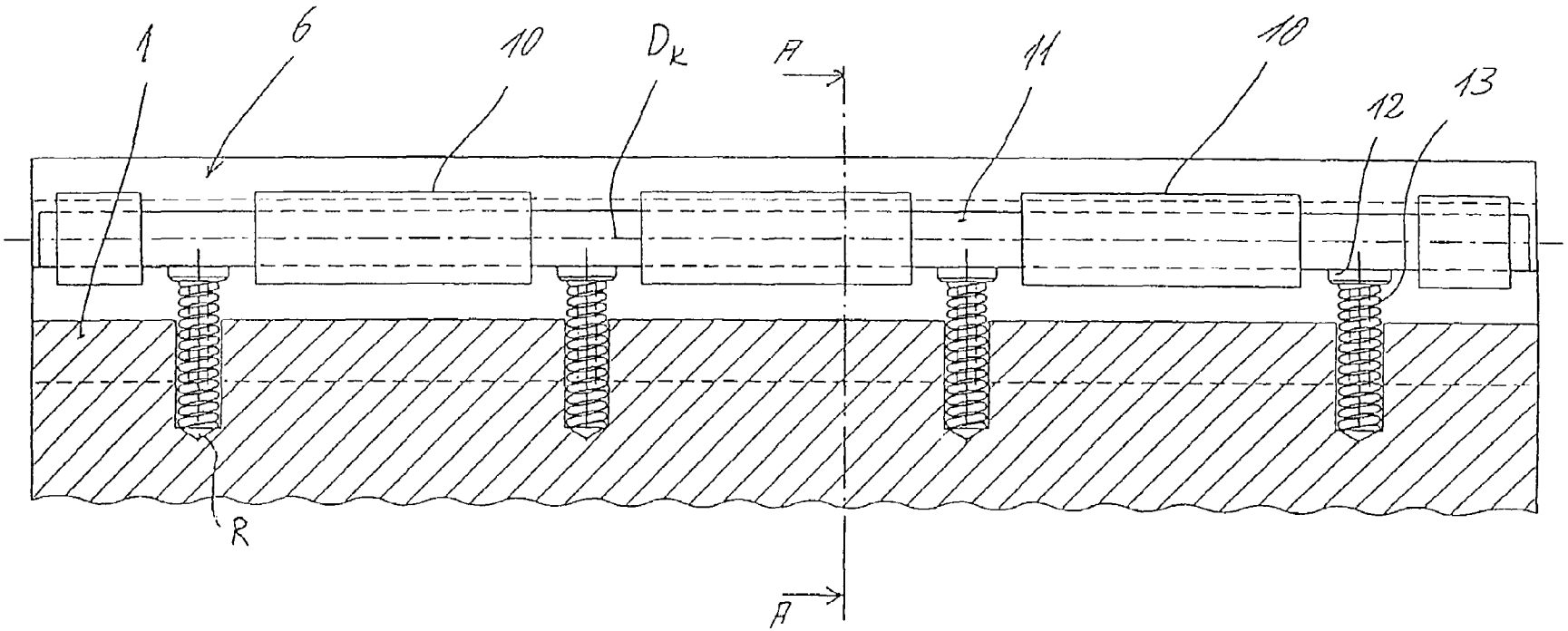
FIG. 2 is a longitudinal partial sectional view of the clamping device according to FIG. 1.

FIG. 2 shows a longitudinal view of the clamping device, wherein the clamping bodies 10, the shaft 11, which connects same or is formed in one piece with them, the mounting pieces 12 and the spring elements 13 are shown in a view and the cylinder 1 is shown in a longitudinal section of the radial plane of symmetry. The cross section A-A shown in FIG. 1 is marked in FIG. 2. The clamping bodies 10 are formed at equal distances along the shaft 11 or are expediently fastened on the continuous shaft 11 secured against displacement and preferably secured against rotation. Slim shaft sections, which project from the clamping bodies 10 like pins and in which each of the spring elements 13 acts on the shaft 11 via a mounting piece 12 each, are left between the clamping bodies 10. The spring elements 13 are accommodated in radial holes of the cylinder 1. The holes form at the same time radial guides for the spring elements 13 formed as compression springs each. The central longitudinal axes of the circular holes are radials R to the axis of rotation $D_Z$ of the cylinder 1, which extend in the radial plane of symmetry of the channel 6.

The shaft 11 is rotatable in the channel 6 around its axis of rotation $D_K$, and the spring elements 13 press the shaft 11 via the mounting pieces 12 against the two channel walls 4 and 5. The channel walls 4 and 5 and the mounting pieces 12 form in their cross section a three-point bearing and as a whole a three-line bearing, by which the clamping bodies 10 are centered. The clamping bodies 10 can slide on both channel walls 4 and 5 and also on the mounting pieces 12. The free rotatability of the shaft 11 is hindered, but not prevented, only by the friction forces in the three contact points. The resulting friction force is determined by the material and the roughnesses of the contact surfaces and by the resulting force of elasticity G exerted by the spring elements 13 on the shaft 11. The clamping force F acting in the clamping gap between the clamping bodies 10 and the channel wall 4 on the ends of the flexible plate 3 is correspondingly set by the judicious selection of the material, the surface treatment and the spring force as desired. During the rotary movement, the clamping force F is increased compared with the state of rest by the component resulting from the centrifugal force Z, which far exceeds the elasticity component G during the printing operation.

The clamping bodies 10 are rotationally symmetrical to their axis of rotation $D_K$. Each of the clamping bodies 10 is a regular cylinder in the exemplary embodiment.

In the initial state of the clamping device, in which the printing cylinder 1 is not spanned or at least the flexible packing 2, 3 is not yet clamped by means of the clamping device, the common axis of rotation $D_K$ of the clamping bodies 10, i.e., the axis of rotation of the shaft 11, extends in the radial symmetry plane of the channel 6. The spring force acting on the shaft 11 from the spring elements 13 points radially to the axis of rotation of the cylinder 1 through the axis of rotation $D_K$ of the clamping bodies 10.

Based on the rotational symmetry of the clamping bodies 10, the balance of forces between the resulting spring force G of the spring elements 13 and the two resulting clamping forces F and E in the two clamping gaps with the channel walls 4 and 5 is the same in each angle of rotation position of the bodies of revolution or clamping bodies 10.

if the two ends of the flexible plate 3 are pushed through the channel opening 7 in parallel to the leading channel wall 4 into the clamping gap between the clamping bodies 10 and the channel wall 4 in the above-described initial state of the clamping device, the spring elements 13 are slightly compressed, and the shaft 11 is moved at the same time slightly to the side in the direction of the trailing channel wall 5 on the mounting pieces 12. The mounting pieces 12 form an axial support surface 9 each for the shaft 11, and the shaft 11 and the clamping bodies 10 can be displaced in parallel in relation to the axial support surface 9. The support surfaces 9 formed by the mounting pieces 12 are flat in the exemplary embodiment and point at right angles, and in the example even exactly perpendicularly to the radial R and to the axis of rotation $D_Z$, as can be recognized in FIG. 1. The support surfaces 9 are guide paths for the transverse displacement of the shaft 11. The slim sections of the shaft 11 remaining between the clamping bodies 10 form meshing members, which can slide and/or roll on the support surfaces 9. The support surfaces 9 as a whole and the channel walls 4 and 5 form three support surfaces, which form angles with each other and which enclose the shaft 11 between them in a triangular pattern and hold it centered. Because of the elastically nonrigid supporting of the support surfaces 9 by the spring elements 13, the shaft 11 is mounted as a whole floatingly in the channel 6. The spring elements 13 and the arrangement of the mounting pieces 12 on the spring elements 13 are sufficiently rigid to prevent tilting movements of the mounting pieces 12 during such a displacement. In the clamped state shown in FIG. 1, in which the flexible packing 2, 3 is clamped in the clamping gap between the clamping bodies 10 and the channel wall 4 and the shaft 11 was correspondingly displaced at right angles to the radial R, the axis of rotation $D_K$ of the clamping bodies 10 extends to the radial symmetry plane of the channel 6 with a parallel offset through a parallel plane, which is represented in the cross section in FIG. 1 by the straight line P which is parallel to the radial R.

Beginning from the initial state, the leading end of the flexible plate 3, which end is bent at an acute angle, is pushed into the clamping gap between the clamping body 10 and the leading channel wall 4 and clampingly fastened as a result to fasten the flexible plate 3. The trailing end of the flexible plate 3 is subsequently introduced into the channel 6 through the channel opening 7 via the trailing limiting edge 8*n* and likewise pushed into the clamping gap, which is formed between the clamping body 10 and the already clamped, leading end of the flexible plate 3. The shaft 11 with the clamping bodies 10 seated on it rotates around its axis of rotation $D_K$ during both pushing-in operations, rolling on the end of the flexible plate 3 that is being pushed in and slides on the mounting pieces 12 and on the trailing channel wall 5. Instead of pushing the two ends of the flexible plate 3 one after another into the clamping gap, both ends may also be pushed simultaneously into the clamping gap, lying one on top of another. Due to the mobility of the clamping bodies 10 and the shaft 11 in both the radial and tangential directions, each relative to the axis of rotation $D_Z$ of the cylinder 1, no setting operations are necessary for clamping the plate ends. In the initial state and in the clamped state, in which latter state a distinction must be made between the nonoperative state of the cylinder and the states of the rotary movement of the cylinder, the clamping device adjusts itself to the thickness of the clamping gap, which thickness is predetermined by the plate ends. The forces acting on the clamping bodies 10 and on the shaft 11 form triangles of forces, which are always congruent to each other, because, although the forces forming the triangle have different values in the different states, their direction does not change. The fact that the clamping force F is the same in each angle of rotation position of the clamping bodies 10 at a given gap thickness because of the rotational symmetry of the clamping bodies 10 also contributes to the simplification. In particular, it is not necessary to ensure that the clamping bodies 10 are in a certain angle of rotation position. The distinction between the clamped position and the released position of the clamping device is eliminated in this respect as well. The removal of the flexible plate 3 with the rubber blanket 2 is also facilitated. Manipulations on the clamping device itself are not necessary either for the clamping or the removal. For removal, the clamped ends of the flexible plate 3 are pulled out of the clamping gap by means of prior-art auxiliary devices, e.g., a suction device.

The shaft 11 may but does not have to be rotatingly driven. If the shaft 11 is rotatingly driven by a motor or optionally via a crank handle, the ends of the flexible plate 3 can also be pulled into the clamping gap and pushed out of the clamping gap by the rotary movement brought about by the motor or manually.

It can also be stated as an example regarding the geometry and the dimensions that the channel opening 7 has a gap width of 1 mm to 2 mm and typically 1.5 mm in the circumferential direction. The diameter of the clamping bodies 10 is between 20 mm and 30 mm. The two channel walls 4 and 5 form an angle with each other that should be at least 60° and at most 90°.

To facilitate the mounting of the clamping device, the channel 6 is formed in an axial recess of the cylinder 1 on the cylinder jacket surface that is larger than the channel 6. A filler 8 is inserted into the recess in an accurately fitting manner. The filler 8 forms the channel walls, especially the channel wall 5, on one side of the radial symmetry plane of the channel 6. The channel walls on the other side of the radial symmetry plane are formed directly by the cylinder 1; this is especially the leading channel wall 4 that participates in the formation of the clamping gap in the exemplary embodiment. The filler 8 forms, furthermore, a section of the cylinder jacket surface, which is short in the circumferential direction, including the trailing limiting edge 8*n* of the channel opening 7. The recess in the cylinder 1 has a sufficiently great extension in the circumferential direction to make possible the insertion of the pressing means and of the shaft 11 forming the clamping body 10. The filler 8 secures the entire arrangement in the channel 6. One peculiarity that shall be mentioned in connection with the filler is the simplified formation of the recess and of the filler 8. The recess is shaped, e.g., milled, as a straight rectangular groove. One of the two parallel side walls of the rectangular groove forms the opposite surface 4. The filler 8 is also characterized by rectangular edges, which can be shaped in a simple manner. In particular, an inner edge is formed, which is open in two directions and in which two side walls of the filler 8 converge at right angles. Of these two side walls, the one pointing radially inwardly forms the opposite surface 5. The filler 8 is fastened to the cylinder 1 by means of screws via the other, radially outwardly pointing side wall of the inner edge. A non-perforated, smooth jacket surface of the cylinder 1 can thus also be obtained in the area of the filler 8.

When the clamping body 10 will hereinafter be described only as one clamping body 10, that description shall correspondingly apply to embodiments with a plurality of clamping bodies 10 as well.

Figure 3:
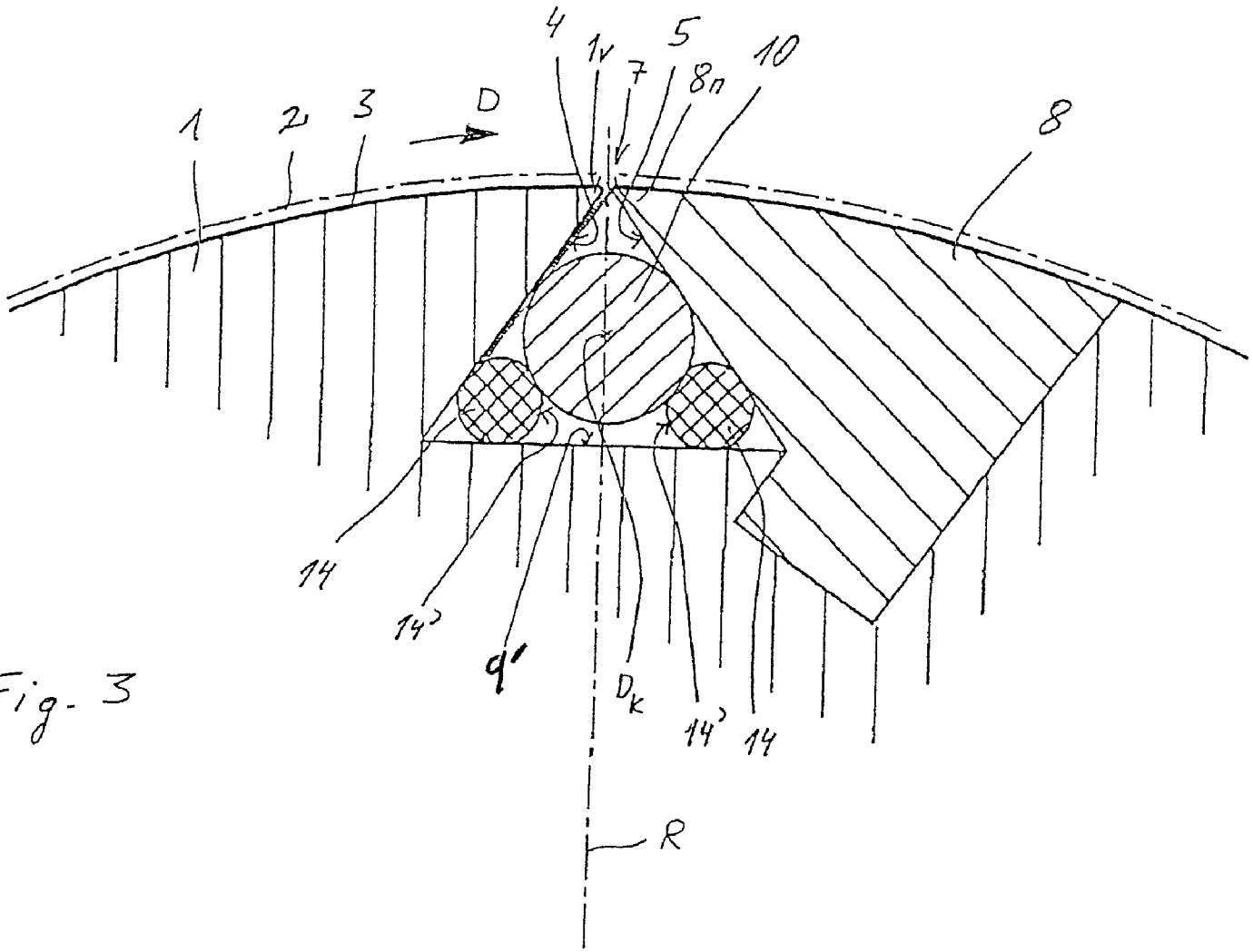
FIG. 3 is a partial sectional view showing a part of a printing cylinder near the jacket surface with an axial channel, in which a clamping device according to a second exemplary embodiment is formed.

FIG. 3 shows a clamping device according to a second exemplary embodiment. The parts of the clamping device that have the same functions as the corresponding parts of the first exemplary embodiment are designated by the same reference numbers. The clamping device according to the second exemplary embodiment also comprises a cylindrical clamping body 10, which can be arranged with a plurality of such clamping bodies 10 on a shaft or rotatably on an axis, or it forms a shaft of a uniform thickness. If a plurality of packings 2, 3 are spanned next to each other in the axial direction around the cylinder 1, a plurality of separate clamping bodies 10 may also be arranged axially next to each other in the channel 6, in which case the axial lengths of the clamping bodies 10 correspond each to the lengths of the packings 2, 3 measured in the axial direction. A plurality of clamping bodies 10, which are identical in their cross sections and preferably also in their lengths, are arranged in likewise preferred embodiments in a number that is greater than the number of packings 2, 3 spanned next to each other around the cylinder 1.

The clamping body 10 or the plurality of clamping bodies 10 according to the second exemplary embodiment is/are of a regular cylindrical shape. The clamping body 10 or the plurality of clamping bodies 10 consists/consist of a preferably hard material, e.g., steel or a material with a comparably high specific gravity. The clamping body 10 is supported on two elastic bearing bodies 14 forming support surfaces 14'. The bearing bodies 14 are in turn supported on the support surface 9', and one bearing body 14 is additionally supported on the channel wall forming the opposite surface 4, and the other bearing body 14 is supported on the channel wall forming the opposite surface 5 by the bearing bodies 14 being arranged in the particular inner edge of the channel 6 being formed.

Before the introduction of the ends of the packing 2, 3, the bearing bodies 14 press the clamping body 10 with a force of elasticity against the opposite surface 4 and against the opposite surface 5. The bearing bodies 14 can perform an inward spring excursion in their combination to the extent that the two ends of the packing 2, 3 can be introduced into the clamping gap. During the elastic yielding of the bearing bodies 14, the clamping body 10 is displaced away from the opposite surface 4, preferably at right angles to the opposite surface 4, against the restoring force of elasticity of the bearing body 14 arranged opposite the opposite surface 4. If the clamping gap is formed with the opposite surface 5, corresponding statements can be made concerning the bearing body 14 arranged opposite the opposite surface 5. Furthermore, the clamping body 10 is rotatable around its own axis of rotation $D_K$. The rotatability is not absolutely necessary, but it does facilitate the pulling in and the removal of the packing 2, 3 with the cylinder not moving.

The bearing bodies 14 according to the second exemplary embodiment are elastic in their material and have a Shore hardness of preferably 70 Shore±10 Shore. They are solid cylindrical. However, a hollow cylindrical design would be conceivable as well. Instead of an elastic material, a hard material, e.g., spring steel, could also form the bearing bodies 14 in the case of the hollow cylindrical design, but these bearing bodies 14 would have to be elastic due to their shape in this case. In a shape elastic design, the bearing bodies may be formed, in particular, by a spiral spring each, which are inserted loosely into the inner edges of the channel 6, like the bearing bodies 14 according to the second exemplary embodiment. The opposite surfaces 4 and 5 form a four-point support for the clamping body 10 with the two bearing bodies 14.

Figure 4:
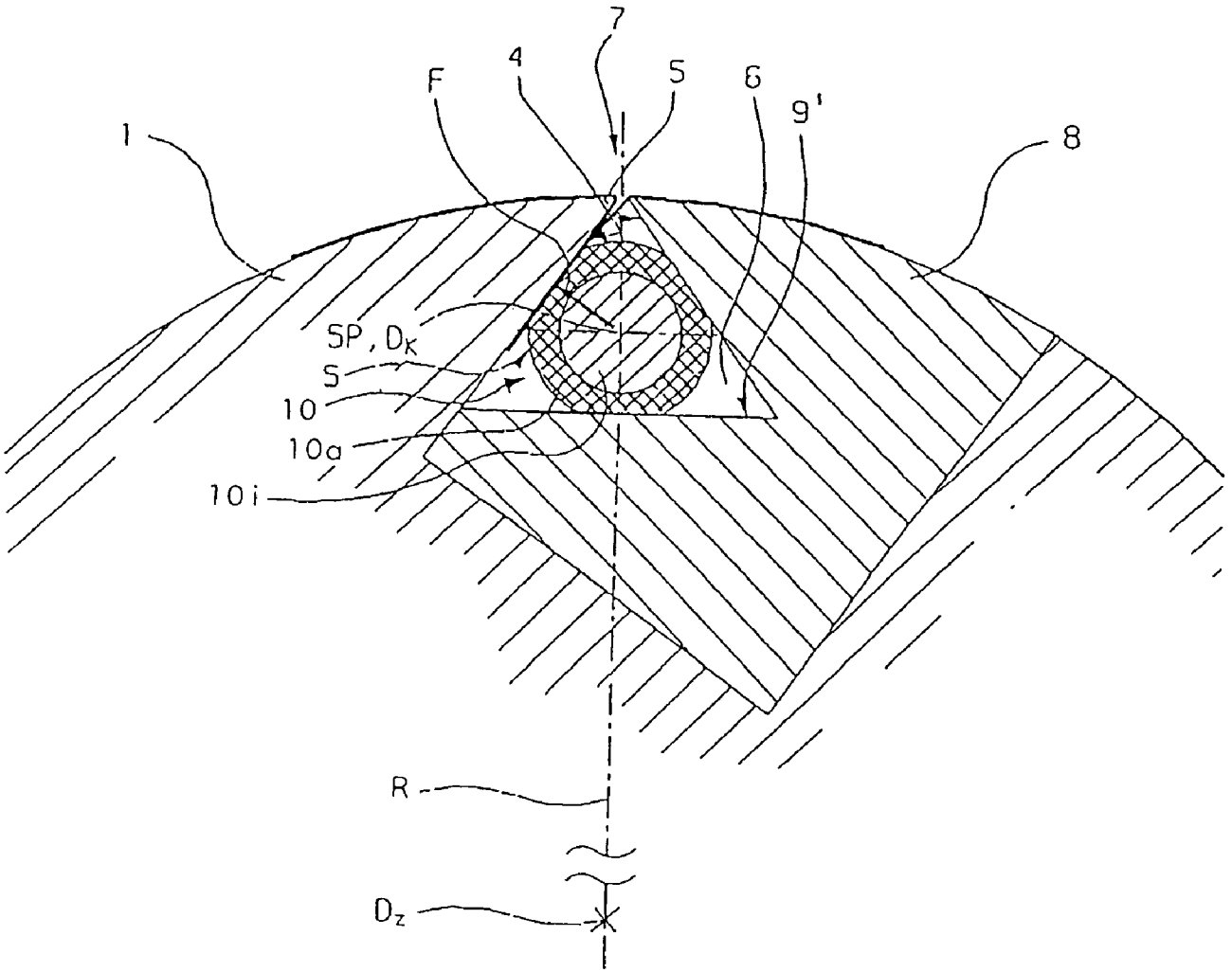
FIG. 4 is a partial sectional view showing a part of a printing cylinder near the jacket surface with an axial channel, in which a clamping device according to a third exemplary embodiment is formed.

FIG. 4 shows a clamping device according to a third exemplary embodiment. The reference numbers of the first exemplary embodiment are also used in the third exemplary embodiment if the parts of the clamping device in question have the same functions as do corresponding parts according to the first exemplary embodiment. Unless indicated otherwise in connection with the third exemplary embodiment, the statements made in connection with the first exemplary embodiment also apply to the third exemplary embodiment.

The clamping device according to the third exemplary embodiment likewise comprises clamping bodies 10, which may be integrated in a shaft or arranged individually and at axially spaced locations from one another in the channel 6, as in the first exemplary embodiment. A continuous shaft, which has the same diameter over its entire length, may also form a single clamping body 10, which is also possible in the first exemplary embodiment and, as was mentioned, in the second exemplary embodiment as well. However, contrary to the first exemplary embodiment and also to the second exemplary embodiment, the clamping bodies 10 are not displaced as a whole when the plate ends are clamped, because the clamping bodies 10 or the clamping body 10 are/is centered and held between support surfaces 4, 5 and 9', none of which is movable in relation to the cylinder 1. The opposite surfaces 4 and 5 correspond to those according to the first exemplary embodiment. The opposite surface 9' is formed by the filler 8. These support surfaces 4, 5 and 9' cannot change their positions relative to each other. It shall be assumed below as an example that the clamping device has a plurality of clamping bodies 10, which are not connected to one another.

To make it possible to introduce the plate ends into the clamping gap, which is formed by each of the clamping bodies 10 with the opposite surface 4, each of the clamping bodies 10 is elastically nonrigid on the surface S that participates in the formation of the clamping gap. The clamping bodies 10 may consist entirely of a corresponding material. Each of the clamping bodies 10 is, however, designed as a composite body in the exemplary embodiment, which comprises a jacket 10*a* made of an elastically nonrigid material and a core 10*i*, which envelopes the jacket 10*a* concentrically to the center of gravity axis SP at a closely spaced location therefrom. The material of the core 10*i* is hard and advantageously has a greater density than the elastically nonrigid material of the jacket 10*a*, so that the density of the clamping bodies 10 can be increased compared with an entirely elastic design. The component of the clamping force originating from the centrifugal force can be increased as a result. The elastically nonrigid material of the jacket 10*a* and the geometry of the channel 6 as well as the diameter of the clamping bodies 10 measured on the surface S shall be such and dimensioned such that the clamping bodies 10 can rotate around the center of the gravity axis SP when the plate ends are introduced into the clamping gap. However, this is not absolutely necessary.

Even though it is already clearly apparent from FIGS. 1 and 4, it shall also be mentioned in connection with the clamping devices according to the first and third exemplary embodiments that they form the same clamping gap with both the opposite surface 4 and the opposite surface 5 arranged opposite. The plate ends of a flexible packing 2, 3 or of two different flexible packings 2, 3 can therefore be introduced into the clamping gap formed with the opposite surface 4 or into the clamping gap formed with the opposite surface 5 as desired and clamped there. The action of the clamping device is independent from the direction of rotation of the cylinder 1.

While specific embodiments of the invention have been shown and described in detail to illustrate the application of the principles of the invention, it will be understood that the invention may be embodied otherwise without departing from such principles.

The invention claimed is:

1. A clamping device for clamping a flexible packing of a cylinder of a printing press, the cylinder having a jacket surface and an axial channel on the jacket surface, the clamping device comprising:

at least one clamping body which has a surface that forms in the channel with an opposite surface a clamping gap for at least one end of the packing protruding through an opening of the channel;

a pressing means which executes a force of elasticity onto the at least one clamping body and includes a mounting means which can be moved against the force of elasticity in a first direction transverse to an axis of rotation of the cylinder and supports the at least one clamping body in said first direction so that the at least one clamping body and the opposite surface are clamped against each other with a clamping force;

the force of elasticity pressing the clamping body simultaneously against said opposite surface and a further opposite surface formed opposite thereto at the other side of the channel, the mounting means forming a guide track along which the at least one clamping body can be guided transversly to the axis of rotation of the cylinder in a second direction not parallel to the first direction while maintaining the clamping gap.

2. A clamping device in accordance with claim 1, wherein the mounting means can be moved in the second direction relative to the cylinder and the mounting means guides the clamping body in and against the first direction.

3. A clamping device in accordance with claim 1, wherein the mounting means guides the clamping body at right angles to the axis of rotation of the cylinder.

4. A clamping device in accordance with claim 1, wherein at least three support surfaces, which center the clamping body and mount the clamping body movably at right angles to the axis of rotation of the cylinder, are formed in the channel.

5. A clamping device in accordance with claim 1, wherein the clamping body is arranged rotatably in the channel, and a surface of the clamping body that touches the mounting means is round, so that the at least one clamping body can roll and/or slide on the mounting means.

6. A clamping device in accordance with claim 1, wherein the surface of the clamping body forming the clamping gap is round.

7. A clamping device in accordance with claim 6, wherein the clamping body is mounted rotatably around an axis of rotation and that the round surface is shaped such and has such an extension in the circumferential direction around the axis of rotation of the clamping body that the clamping gap is maintained during a rotary movement of the clamping body around the axis of rotation.

8. A clamping device in accordance with claim 6, wherein the round surface of the clamping body is rotationally symmetrical relative to an axis of rotation of the clamping body.

9. A clamping device in accordance with claim 1, wherein the clamping body is rotatable relative to the pressing means around an axis of rotation.

10. A clamping device in accordance with claim 1, wherein the pressing means is a spring means, which acts on the clamping body with the force of elasticity.

11. A clamping device in accordance with claim 1, wherein the pressing means exerts the force of elasticity on the clamping body, which said force points radially toward the axis of rotation of the cylinder or has at least a radial component.

12. A clamping device in accordance with claim 1, wherein a pin, via which the at least one clamping body is supported on the mounting means, projects from the at least one clamping body.

13. A clamping device in accordance with claim 12, wherein the pin connects the at least one clamping body with at least one additional clamping body to form a clamping body group, and the clamping bodies of the clamping body group are supported via the pin together on the mounting means.

14. A clamping device in accordance with claim 1, wherein the channel is provided for a plurality of said packings arranged axially next to each other, and no more than a single clamping body is provided per packing.

15. A clamping device in accordance with claim 1, wherein a single clamping body is arranged in the channel.

16. A clamping device in accordance with claim 1, wherein the center of gravity of the clamping body is movable in relation to the mounting means at right angles to the force exerted by the pressing means.

17. A clamping device in accordance with claim 1, wherein the opposite surface is formed for the clamping body on a leading side of the channel and the further opposite surface is formed on a trailing side of the channel relative to the cylinder.

18. A clamping device in accordance with claim 17, wherein the clamping gap can be formed with one or the other of the opposite surfaces as desired depending on a direction of rotation of the cylinder.

19. A clamping device in accordance with claim 18, wherein the pressing means presses the clamping body simultaneously with a pressing force against the opposite surface formed on the leading side of the channel and with a pressing force against the further opposite surface formed on the trailing side of the channel, wherein a force exerted by the pressing means on the clamping body forms a triangle of forces with the clamping force and the pressing force.

20. A clamping device in accordance with claim 19, wherein the opposite surface formed on the leading side of the channel and the further opposite surface formed on the trailing side of the channel are shaped such and oriented such in relation to a radial to the axis of rotation of the cylinder that the at least one clamping body is pressed against both said opposite surfaces with an essentially equal force each.

21. A clamping device in accordance with claim 1, wherein a plurality of the clamping bodies are arranged at axially spaced locations from one another and that the pressing means has a plurality of spring elements, which are arranged at axially spaced locations next to each other in the channel along a common longitudinal axis of the clamping bodies and act on the clamping bodies to generate the clamping force.

22. A clamping device in accordance with claim 21, wherein the clamping bodies are seated on an axis or shaft or are made in one piece by a shaft, and that the spring elements act on the shaft such that a uniform clamping force is generated over the length of the shaft.

23. A clamping device in accordance with claim 1, wherein a recess, is formed on the jacket surface of the cylinder, and at least one filler is inserted into the recess to form the channel and the limiting edges of the opening of the channel.

24. A clamping device in accordance with claim 23, wherein the recess is a straight axial groove with parallel, flat side walls, which point at an angle to a radial relative to the axis of rotation of the cylinder, and one of which forms the opposite surface or the further opposite surface for the at least one clamping body.

25. A clamping device in accordance with claim 23, wherein the filler has an inner edge, which is open toward two longitudinal sides of the filler, and in which the filler forms the opposite surface or the further opposite surface for the at least one clamping body, the inner edge being formed between two flat surfaces of the filler, which point at right angles toward each other.

26. A clamping device in accordance with claim 1, wherein the channel widens in cross section from the channel opening on both sides of the channel opening, so that the channel opening is formed between two limiting edges which has an acute-angled cross section.

27. A clamping device in accordance with claim 1, wherein the clamping body performs a rotary movement in a clamping direction of rotation when the flexible packing is pulled or pushed into the clamping gap, and that a blocking means is provided, which is coupled with the cylinder and with the clamping body and prevents a rotary movement of the clamping body against the clamping direction of rotation in a releasable blocking engagement.

28. A clamping device in accordance with claim 27, wherein the blocking means is formed by a friction brake or a free-running mechanism blocking the clamping direction of rotation.

29. A clamping device in accordance with claim 1, wherein the clamping body is rotatingly driven.

30. A clamping device for clamping a flexible packing of a cylinder of a printing press, the cylinder defining an axial channel on a cylinder surface, the clamping device comprising:

a clamping body with a surface defining, with an opposing surface of the cylinder, a clamping gap in the channel, one end of the packing passing through an opening of the channel;

a pressing element which exerts an elasticity force on said clamping body, said pressing element including a bearing element moveable in a first direction against the elasticity force at right angles to an axis of rotation (Dz) of the cylinder, said bearing element supports said clamping body in said first direction, so that said clamping body and said opposing surface are pressed against each other with a clamping force;

said elasticity force presses said clamping body simultaneously against said opposing surface and an additional opposing surface formed on another side of the channel diametrically opposite with respect to the channel;

said bearing element forming a guideway along which said clamping body can be moved in a second direction that is not parallel to said first direction and is at right angles to said axis of rotation of the cylinder while said clamping gap is maintained, said guideway firmly supporting said clamping body in a plurality of positions along said second direction, said clamping body being movable with respect to said bearing element along said guideway.

* * * * *